US011419431B2

(12) United States Patent
Li

(10) Patent No.: US 11,419,431 B2
(45) Date of Patent: Aug. 23, 2022

(54) AIR BED

(71) Applicant: Yonghe Li, Guangdong (CN)

(72) Inventor: Yonghe Li, Guangdong (CN)

(73) Assignee: WANGLI PLASTIC & ELECTRONICS (HUIZHOU) CO., LTD., Guangdong (CN)

( * ) Notice: Subject to any disclaimer, the term of this patent is extended or adjusted under 35 U.S.C. 154(b) by 0 days.

(21) Appl. No.: 16/699,365

(22) Filed: Nov. 29, 2019

(65) Prior Publication Data

US 2021/0127849 A1 May 6, 2021

(30) Foreign Application Priority Data

Nov. 1, 2019 (CN) ..... 201911061862.4

(51) Int. Cl.
*A47C 27/08* (2006.01)

(52) U.S. Cl.
CPC ..... *A47C 27/081* (2013.01); *A47C 27/087* (2013.01)

(58) Field of Classification Search
CPC ..... A47C 27/081; A47C 27/087
See application file for complete search history.

(56) References Cited

U.S. PATENT DOCUMENTS 4,190,917 A * 3/1980 Calleance ..... A47C 27/087 5/682
6,233,768 B1 * 5/2001 Harding ..... A47C 20/025 5/706
7,353,555 B2 4/2008 Lu
2006/0265810 A1 * 11/2006 Wu ..... A47C 27/081 5/712
2012/0284923 A1 * 11/2012 Jensen ..... A61G 1/04 5/627
2018/0027985 A1 * 2/2018 Ocegueda Gallaga ..... A47C 27/081
2019/0059606 A1 * 2/2019 Huang ..... A47C 27/081

* cited by examiner

*Primary Examiner* — Eric J Kurilla
(74) *Attorney, Agent, or Firm* — Muncy Geissler Olds & Lowe P.C.

(57) ABSTRACT

The present invention discloses an air bed including a mattress body formed by a top surface, a bottom surface and a side wall. The mattress body is provided with at least two layers of side walls being an inner side wall and an outer side wall respectively. The inside of the inner side wall forms a bed air chamber of the mattress body. A side wall air chamber of the mattress body is formed between the inner side wall and the outer side wall. The inside of the side wall air chamber between the inner side wall and the outer side wall is connected with a plurality of side wall drawstrings. The side wall drawstrings form a bed edge of the mattress body with the inner side wall, the outer side wall, and the side wall top surface/side wall bottom surface respectively.

9 Claims, 9 Drawing Sheets

AIR BED

TECHNICAL FIELD

The present invention relates to the technical field of inflatable products, and specifically to an air bed.

BACKGROUND

Modern people are increasingly eager to live a simple and free life, but the problems of bulky furniture which is inconvenient to move and occupies a large space have also become important factors in constraining freedom of people. For example, a bed is a necessity in lives of people, and is needed for sleep every day. However, traditional beds are made of wood or metal and are large in size, heavy in weight and inconvenient to move, and bring much inconvenience to the lives of people.

In view of the above factors, an air bed is more and more popular among people since the bed is convenient for storage when not inflated and becomes the bed after inflation with advantages of being easy to carry, comfortable, simple and convenient, low in cost and environmentally friendly and the like.

But existing air beds generally have the following deficiencies which limit the development of the air bed industry. Firstly, the existing air beds generally have a single air chamber, such air bed easily deforms and is not flat enough during inflation, and has same hardness degree at each position of the air bed, which is inconvenient to adjust independently and is impossible to meet the requirements of two or more people on the same air bed at the same time. Secondly, the air bed easily deforms, thereby bringing bad experience and discomfort to a user and affect the sleep of the user. Thirdly, the existing air beds are generally easy to collapse at the edge position, and the user is easy to slide down when sleeping, resulting in poor safety and comfort. Fourthly, the mattresses of the existing air beds on the market have poor air ventilation, which cause people to feel chest tightness and uncomfortable after sleeping on the bed for a long time and long-term heavy moisture exerts adverse influence on the health of human body. Fifthly, the existing air beds can generate big noise, and inflatable mattress can also generate a sound when the user turns the body on the bed, thereby influencing the sleep of the user. Sixthly, the mattress can expand easily in an irregular shape after inflation, which influences the using effect.

On the other hand, drawstrings are required to provide in the body of the inflatable chamber in order to maintain the inflatable mattress in a desired shape in an inflated state. The drawstrings used by traditional inflatable mattresses are all vertically connected to a face sheet and a bottom sheet of the inflatable mattress, and the drawstrings may exert a pulling force in a vertical direction on the face sheet and the bottom sheet upon inflation of the inflatable mattress. However, the inflatable mattress with such a structure has the following deficiencies. Firstly, the joint seam at which the drawstrings connect the face sheet or the bottom sheet is relatively concentrated with force, thereby causing that the joint where the drawstrings connect the face sheet or the bottom sheet easily breaks or that the face sheet or the bottom sheet is torn apart. Secondly, a bed body is easy to be locally collapsed or convex upwards to be inclined without enough stability, so that the using effect and service life are affected.

SUMMARY

The present invention aims to overcome at least one deficiency of the above prior art, and provides an air bed for solving technical problems that existing air beds are easily deformed, not flat enough, and poor in comfort.

According to the present invention, an air bed includes a mattress body defined by a top surface, a bottom surface and a side wall. The mattress body has at least two layers of side walls being an inner side wall and an outer side wall respectively. The inside of the inner side wall forms a bed air chamber of the mattress body. A side wall air chamber of the mattress body is formed between the inner side wall and the outer side wall. The inside of the side wall air chamber between the inner side wall and the outer side wall is connected with a plurality of side wall drawstrings. The side wall drawstrings form a bed edge of the mattress body with the inner side wall, the outer side wall, and a side wall top surface/side wall bottom surface respectively.

In the present invention, at least two layers of side walls are provided in the mattress body, so that the mattress body is more stable, a user sleeps more comfortably on the mattress body and is prevented from sliding under the bed. Moreover, the hardness degree of a surrounding surface of the mattress body can be adjusted independently, and the requirements of the user are better met. The side wall air chamber of the mattress body is formed between the inner side wall and the outer side wall, which, on the one hand, facilitates independent air intake and air discharge to control the hardness degree of the side wall air chamber separately. On the other hand, the side wall air chamber is pulled, restrained and shaped by the inner side wall, the outer side wall, and the top surface and the bottom surface enclosed by the inner side wall and the outer side wall, so that the shape of the side wall air chamber is fixed, not easily deformed, and has certain amount of hardness. After the user sleeps on the bed, the side wall air chamber forms the edge of the air bed, and can limit the edge of the air bed, prevent the edge of the bed from collapsing, and improve safety and comfort degree during the use.

The side wall drawstrings are provided between the inner side wall and the outer side wall, which, on the one hand, can further ensure the hardness degree of the bed edge. On the other hand, the position where the side wall and the bed drawstrings are connected is limited during inflation and is not easily deformed, while the portion, not connected to the bed drawstrings, in the side wall air chamber slightly expands, so that the formed bed edge slightly projects in a direction of periphery to form a protruding limit so as to avoid collapse of the bed edge.

Further, traditional air beds are easy to collapse due to lacking hardness support of the inner side wall and the side wall drawstrings, and the height of a bed body is generally limited. The present technical scheme provides a side wall air chamber in which side wall drawstrings are provided to enable the bed to be more stable and less deformable with larger load bearing capacity. Therefore, the height can be further guaranteed, and the bed people sit or lie on is flatter and firmer.

Still further, the top surface of the bed air chamber is formed by bonding a flock layer and a PVC/TPU layer in which the flock layer is provided outside the PVC/TPU layer. The bottom surface of the bed air chamber is formed by bonding a cloth layer and a PVC/TPU layer in which the cloth layer is provided outside the PVC/TPU layer. The outer side wall of the bed air chamber is formed by bonding a flock layer and a PVC/TPU layer, or a cloth layer and a PVC/TPU layer.

In the present invention, providing the flock layer on the top surface of the mattress body can reduce noise generated by friction between PVC material and human body. In addition, the flocking on the top surface of the mattress body enables the air mattress to be more delicate with air ventilation, which provides a more comfortable feeling when human skin touches the mattress and improves the comfort of use.

The bottom surface of the mattress body is formed by bonding the cloth layer and the PVC/TPU layer. The cloth layer can reduce the noise generated when the mattress is touched, avoid rupture, and improve service life of the mattress body.

In addition, as to the mattresses in the prior art, the mattress body tends to expand into an arc shape after inflation, which cause that the mattress body has a bread-like projection, the mattress body is not flat enough without pleasing appearance, and the service life is affected. The arrangement of the cloth layer limits the expansion of the PVC/TPU layer, so that the stretch of the whole mattress body is flatter with more pleasing appearance, a technical effect that the whole mattress body is not easily deformed is achieved, the hardness degree of the mattress body is improved, a higher comfort degree of the mattress body is realized, the mattress body is prevented from rupture, and the service life is prolonged.

Preferably, the bottom surface and the outer side wall of the mattress body are both formed by bonding the cloth layer and the PVC/TPU layer, in which the cloth layer can reduce the noise generated when the mattress is touched, improve the toughness, avoid rupture, and enhance comfort and the service life during the use.

Further, the material of the inner side wall is PVC or TPU, which enable better welding or bonding with the outer side wall and the top surface and the bottom surface of the bed air chamber, and air tightness is better.

Further, the inside of the bed air chamber is provided with a plurality of bed drawstrings which are respectively connected to the top surface and the bottom surface of the bed air chamber and are at least partially arranged in an inclined way in the bed air chamber.

According to the present invention, the bed drawstrings act to restrain the mattress body from forming the bed body in a flat shape. However, due to the consistent force direction, the vertically arranged bed drawstrings still can cause a problem that the top surface and the periphery of the mattress body project, that is, a bread-like convex is formed, thus leading to poor aesthetics of the mattress. Due to the fact that vertical lines at the top of the bed drawstrings and the vertical lines at the bottom of the bed drawstrings are not on the same straight line, and that the fore points of the top surface and the bottom surface are spaced apart from each other, so that the top surface and the bottom surface of the mattress body can be better restrained, and the function of preventing the top surface and the periphery of the mattress body from projection can be realized. Meanwhile, the top surface and the bottom surface of the mattress body can receive more uniform force and the stability is better.

According to the present invention, due to the fact that structural layers of the top surface and the bottom surface of the mattress body are inconsistent with each other, and force degree of the top surface relative to the bottom surface, degree of expansion, and PVC hardness degree and the like are also different, so that the inclined arrangement of the drawstrings adjusts the force applied to the bottom surface and the top surface of the mattress body and further balances the force. The top surface and the bottom surface of the mattress body can be flatter with more stability since force positions on the upper side of the drawstrings and force positions on the lower side of the drawstrings are not on the same vertical line. Therefore, the force on different sides can be better matched, and the force between the top surface and ground/side is more balanced. Meanwhile, the flatness between the top surface and the bottom surface/side can be adjusted, so that the force applied to the mattress body is more balanced, and the stability and aesthetics are better.

Further, the drawstrings include at least two sets of side wall drawstrings being an upper side wall drawstring and a lower side wall drawstring respectively. The upper side wall drawstring is connected between a medium-upper part of the inner side wall and the outer side wall. The lower side wall drawstring is connected between a medium-lower part of the inner side wall and outer side wall. The side wall air chamber is divided into upper, middle and lower air chambers.

In the present invention, the upper side wall drawstring and the lower side wall drawstring, on the one hand, can enable the top surface and the bottom surface of the side wall flatter with high hardness, and on the other hand, the surrounding surface of the outer side wall can also be restricted from outward deformation.

Further, the upper, middle and lower three air chambers of the side wall air chamber are independent of each other, and control air intake and air discharge separately; or the upper, middle and lower three air chambers of the side wall air chamber are communicated with each other to form an air chamber, and the bed air chamber and the side wall air chamber are independent of each other; or the upper, middle and lower three air chambers of the side wall air chamber are communicated with the bed air chamber of the mattress body to form an air chamber.

In the present invention, the side wall air chamber is divided into three independent air chambers including air chambers, which are convenient for separately controlling the air intake and air discharge. The hardness degree between each air chamber can be different to better meet the requirements of the user.

The upper air chamber forms an upper bed edge of the mattress body, and the lower air chamber forms a lower bed edge of the mattress body. The upper bed edge and the lower bed edge are stretched and supported by the side wall drawstrings, the shaping effect is better, and the bed edge is prevented from collapsing.

Alternatively, the upper, middle and lower three air chambers of the side wall air chamber can also be communicated with each other to form an air chamber, thus facilitating independent inflation and deflation of the side wall air chamber.

In addition, the upper air chamber and the lower air chamber of the side wall air chamber can also be connected through a hose, or the upper, middle and lower three air chambers can be communicated with each other and the like in order to meet the requirements of more users.

Further, two ends of the side wall drawstrings are respectively connected to the inner side wall and the outer side wall, and the side wall drawstrings are arranged in parallel or in an inclined way in the side wall air chamber.

The traditional air bed does not have an independent side wall air chamber and side wall drawstrings, or the provided bed drawstrings are used to directly pull outer side and top/bottom of the bed body. Therefore, the bed edge position is easy to collapse, and the direct pull of the outer side and the top/bottom of the bed body by the bed drawstrings is also prone to cause upward bulge or downward convex problem of the bed edge, so that the bed body is not flat enough. According to the technical scheme, the side wall drawstrings form tension between the inner side wall and the outer side wall, the bed drawstrings can receive more uniform force due to the inclined bed drawstrings, the stability of the bed body is better, and the product is more durable.

Further, four corners of the inner side wall are provided with angle-cutting lines extending from top/bottom of the inner side wall to connection positions between the inner side wall and the side wall drawstrings, and the connection positions between the inner side wall and the side wall drawstrings are staggered from end-point positions of the angle-cutting lines.

Further, the angle-cutting lines intersect with the inner side wall, and the angles formed by the intersection are oblique pulling angles which are obtuse angles.

The arrangement of the angle-cutting lines is more suitable for force condition of the whole mattress, so that the inner side wall transits more evenly between the bed air chamber and the side wall air chamber, and the joint performance is higher.

According to the present invention, the position where the inner side wall welds or bonds the top surface of the bed air chamber is a first connection position; the position where the inner side wall welds or bonds the upper side wall drawstring is a second connection position; the position where the inner side wall welds or bonds the lower side wall drawstring is a third connection position; the position where the inner side wall welds or bonds the bottom surface of the bed air chamber is a fourth connection position; the position where the outer side wall welds or bonds the top surface of the mattress body is a fifth connection position; the position where the outer side wall welds or bonds the upper side wall drawstring is a sixth connection position; the position where the outer side wall welds or bonds the lower side wall drawstring is a seventh connection position; and the position where the outer side wall welds or bonds the bottom surface of the mattress body is an eighth connection position. Each connection position has a different position. The oblique pulling angles are respectively provided between the first connection position and the second connection position, and between the third connection position and the fourth connection position.

Further, the hardness value of the bottom surface of the bed air chamber is greater than the harness value of the top surface of the bed air chamber.

According to the present invention, due to the fact that the structural layers of the top surface and the bottom surface are different, and the PVC hardness value of the structural layer on the top surface is lower than the PVC hardness value of the structural layer on the bottom surface, that is, the top surface has a larger flexibility. The PVC hardness of the PVC/TPU layer on the top surface of the mattress body is adjusted to between 35 and 45 PHR, preferably 40 PHR, so as to further enable the mattress body to maintain flat with pleasing appearance and avoid the formation of bread-like projection on the surface of the mattress body, thereby better matching and adapting the PVC hardness and flexibility of the structural layer on the bottom surface.

A higher PHR value leads to a lower PVC hardness degree of PVC, a larger expansion coefficient of PVC mattress body, larger flexibility and easier deformation; or on the contrary, the expansion coefficient is smaller, the flexibility is smaller, and the mattress body is not easy to deform. As to traditional PVC mattresses, the PVC hardness degree is generally required to be between 50 and 56 PHR in order to acquire a balance between the expansion coefficient and the flexibility.

The parameter PHR means the parts of added rubber or resin per 100 parts (by mass) of PVC material, and the PVC hardness degree of the PVC is indirectly indicated by the parts of indirect adding the rubber or the resin. The PHR value can be measured using a Rockwell hardness tester.

According to the present invention, the flock layer on the top surface is fiber velvet which does not affect the flexibility of PVC after bonding PVC. The cloth of the cloth layer on the bottom surface is an integral part after bonding PVC since the cloth has small flexibility or no flexibility. Therefore, the cloth layer acts to restrain and restrict the flexibility of the PVC, thereby limiting expansion and deformation of the mattress body. The PVC harness degree of the bonding layer on the bottom surface is adjusted to between 55 and 75 PHR, and is further adjusted to between 60 and 70 PHR. Therefore, the PVC hardness degree of the bonding layer on the bottom surface is lower, and it is ensured that the bottom surface is not easy to deform, gives people more comfort when is used, and further meets the needs of the user.

Further, the cloth layer is made of nylon, or polyester, or polyester-cotton blended fabrics, or cotton cloth, or mesh cloth.

According to the present invention, the PVC/TPU layers on the top surface, bottom surface and the side are all provided on the inside, and the flock layer/cloth layer is provided on the outside, so that the noise reduction effect is better. Both the connection between the top surface and the side and the connection between the bottom surface and the side are firstly achieved through the connection of PVC/TPU layer and the PVC/TPU layer, so that the air tightness and toughness of the joint are more ensured and the mattress is more stable.

Welding methods include high frequency welding and hot melt welding, and bonding methods include adhesive bonding or emboss bonding. The top surface, the bottom surface and the side of the mattress body are connected by hot melt welding or adhesive bonding. The molding between the PVC/TPU and the flock layer and between the PVC/TPU and the cloth layer is achieved through the adhesive bonding or hot melt bonding or emboss bonding.

Further, the obliquely provided bed drawstrings are gradually inclined from the top surface of the bed air chamber to the bottom surface of the bed air chamber towards the direction of the inner side wall.

The bed drawstrings are gradually inclined from the top surface of the bed air chamber to the bottom surface of the bed air chamber towards the direction of the inner side wall, so that the bottom surface of the bed air chamber can receive more uniform force and grasp the ground with more stability, thereby preventing the mattress body from rolling over.

According to the present invention, due to the fact that the structured layers of the top surface and the bottom surface of the bed air chamber are inconsistent with each other, and the force degree of the top surface relative to the bottom surface, the degree of expansion, and the hardness degree and the like are also different, so that the inclined arrangement of the bed drawstrings can better match the force on different sides, and the force between the top surface and the bottom surface is more balanced. Meanwhile, the flatness between the top surface and the bottom surface can be adjusted, so that the force applied to the bed air chamber is more balanced, and the stability and aesthetics are better.

Further, the more the bed drawstrings are provided towards the center of the bed air chamber, the larger the angle formed by the bed drawstrings and the bottom surface of the bed air chamber. The angle $\alpha$ formed by the bed drawstrings and the bottom surface of the bed air chamber is $60° < \alpha \leq 90°$.

The center line of the long side of the bed air chamber is taken as the middle. The bed drawstrings are from the middle of the bed air chamber to the inner side wall, and the inclination angle formed with the bottom surface of the bed air chamber is gradually reduced. The more the bed drawstrings are provided towards the inner side wall, the smaller the angle, and the more the angle is inclined to 60°; the more the bed drawstrings are provided towards the middle of the bed air chamber, the larger the angle, and the more the angle is inclined to 90°.

According to the present invention, the structural layer on the top surface has a small PVC hardness degree and larger flexibility, while the structural layer on the bottom surface or the side has no flexibility or smaller flexibility since the cloth layer is added. Therefore, the inclined arrangement of the bed drawstrings is better adapted to the difference in the flexibility of the top surface and the bottom surface. The range of the angle $\alpha$ formed by the bed drawstrings and the bottom surface of the bed air chamber is $60° < \alpha \leq 90°$ in order to better adapt to the PVC hardness degree of the top surface of the bed air chamber.

In the present invention, the pulling of the bed drawstrings not only causes the bed drawstrings on the top surface to stagger from the bed drawstrings on the bottom surface, but also causes the force of the bed drawstrings not to be in a uniform direction. In addition, the mutual pulling of the inclined bed drawstrings produces forces canceling each other to achieve balance of the force receiving surface. The bed drawstrings are gradually inclined from the middle to the inner side wall of the bed air chamber, so that the top surface of the mattress reaches a flat effect after inflation.

Further, the center line of the long side of the bed air chamber is taken as a symmetry axis. When the number of the bed drawstrings is even, the bed drawstrings are symmetrically and obliquely provided in space formed by the periphery of the symmetry axis of the bed air chamber. When the number of the bed drawstrings is odd, a set of bed drawstrings are provided in the space where the symmetry axis of the bed air chamber is located and are perpendicular to the bottom surface and the top surface of the bed air chamber, and the bed drawstrings outside the symmetry axis are symmetrically and obliquely distributed in the space formed by the periphery of the symmetry axis of the bed air chamber.

Further, the bed drawstrings are gradually inclined outward from the top surface of the bed air chamber to the bottom surface of the bed air chamber.

The bed drawstrings are gradually inclined outward from the top surface of the bed air chamber to the bottom surface of the bed air chamber, that is, the force position of the bed drawstrings on the top surface of the bed air chamber is close to the middle portion of the bed air chamber, and the force position of the bed drawstrings on the bottom surface of the bed air chamber is far away from the middle portion of the bed air chamber. Therefore, the bed air chamber grasps the ground with more stability and is difficult to roll over, and has beneficial effects of being more stable and flat.

Further, the bed drawstrings are in a sheet-like or columnar or ring structure. The sheet-like bed drawstrings are provided along inner circumference of the bed air chamber, and have a curved or linear design at the joint of the top surface/bottom surface of the mattress body. The bed drawstrings in the columnar or ring structure are uniformly provided in the bed air chamber.

The top/bottom of the bed drawstrings in the sheet-like structure has a linear or wavy design, so that the force is more balanced and the appearance is more pleasing.

The bed drawstrings in the columnar structure are more stable, and have the beneficial effects of uniform force on the top surface and the bottom surface and good appearance.

The bed drawstrings in the columnar structure include cylindrical bed drawstrings and 8-shaped bed drawstrings or honeycomb bed drawstrings. The bed drawstrings in the present technical scheme are not limited to the above structural designs, and can also be other design patterns, for example, the bed drawstrings can be designed as a ring structure.

Further, a plurality of independent air chambers are provided in the bed air chamber, and each air chamber controls air intake and air discharge separately.

According to the present invention, the bed air chamber is provided with independent air chambers for the user to independently adjust the hardness degree of each bed. The arrangement of independent bed air chambers for adjustments of hardness degree can meet the requirements of users more and the adaptability is higher since each person may have different requirements on the hardness degree of mattress when two or more people sleep on one mattress.

Compared with the prior art, present invention can obtain some beneficial effects.

(1) According to the present invention, the side wall air chamber is provided between the inner side wall and the outer side of the air bed, so that the bed edge of the air bed can be more stable and can receive more uniform force. Meanwhile, the side wall drawstrings are provided in the side wall air chamber, and the height of the bed body is more guaranteed, the supporting effect of the side wall air chamber is better, and the user sleeps more smoothly and comfortably on the bed.

(2) According to the present invention, the bed drawstrings of the bed air chamber are obliquely arranged, so that the force points of the top surface and the bottom surface of the same bed drawstring are spaced apart from each other. Therefore, the top surface and the bottom surface can receive more uniform force, and the bread-like outward projection degree of a face sheet and periphery of the mattress is greatly reduced to achieve a more pleasing appearance. Meanwhile, the bed drawstrings are provided to be gradually inclined from the top surface to the bottom surface towards the direction of the inner side wall, so that the bottom surface of the mattress grasps the ground with more stability, and the stability and flatness of the mattress body is guaranteed.

(3) According to the present invention, the bottom surface of the bed air chamber is formed by bonding the cloth layer and the PVC/TPU layer, thereby effectively reducing the noise of the mattress body, improving sleep quality and using effect of the user. Meanwhile, the irregular expansion rate of the mattress body is also reduced, the mattress body is flatter and not easy to deform, the hardness of the mattress body is improved, and the comfort and the service life are improved.

(4) According to the present invention, a structural layer design of bonding the flock layer and the PVC/TPU layer on the top surface of the bed air chamber is adopted to improve the problems of loud noise on the top surface of the air bed and poor air ventilation. Meanwhile, the structural layer design of bonding the cloth layer and the PVC/TPU layer on the bottom surface and the side of the bed air chamber can effectively improve the problems of partial bread-like projection and expansion and deformation after inflation of traditional air beds, so that the mattress body is flatter, the cloth layer can effectively reduce the risks that the bed air chamber is scratched, grazed or pierced and the like, and the service life of the mattress body is prolonged.

DESCRIPTION OF EMBODIMENTS

Figure 1:
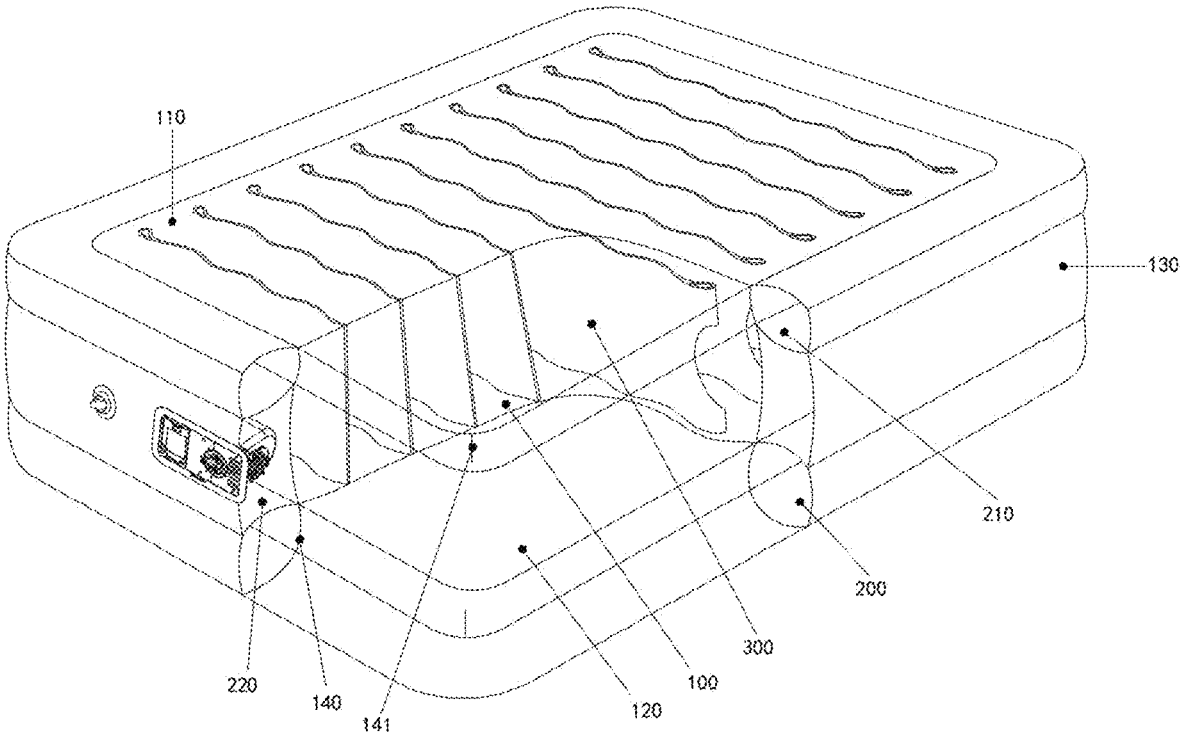
FIG. 1 is a perspective view of structure of a bed body according to Embodiment 1 of the present invention.

The drawings of the present invention are for illustration purpose only and are not intended to limit the present invention. In order to better illustrate the following embodiments, certain components of the drawings may be omitted, enlarged, or reduced, and do not represent the dimensions of the actual product. It will be understood that some known structures and descriptions thereof in the drawings may be omitted for those skilled in the art.

Embodiment 1

Figure 2:
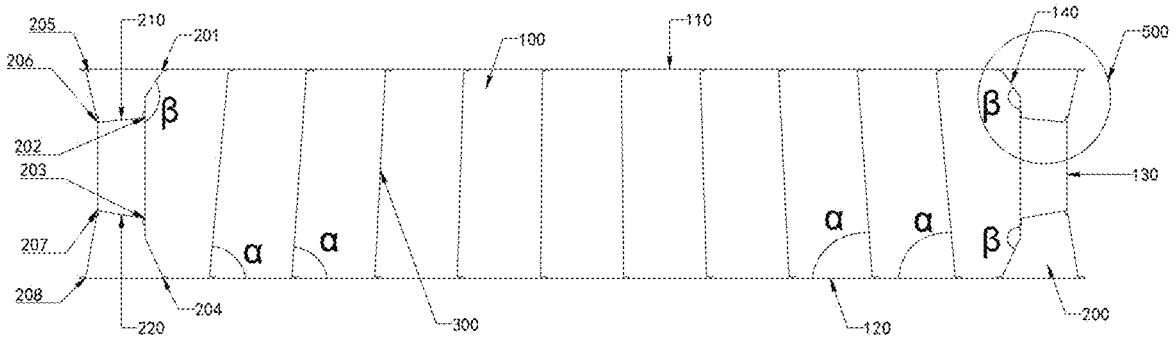
FIG. 2 is a cross-sectional view of the present invention.
Figure 4:
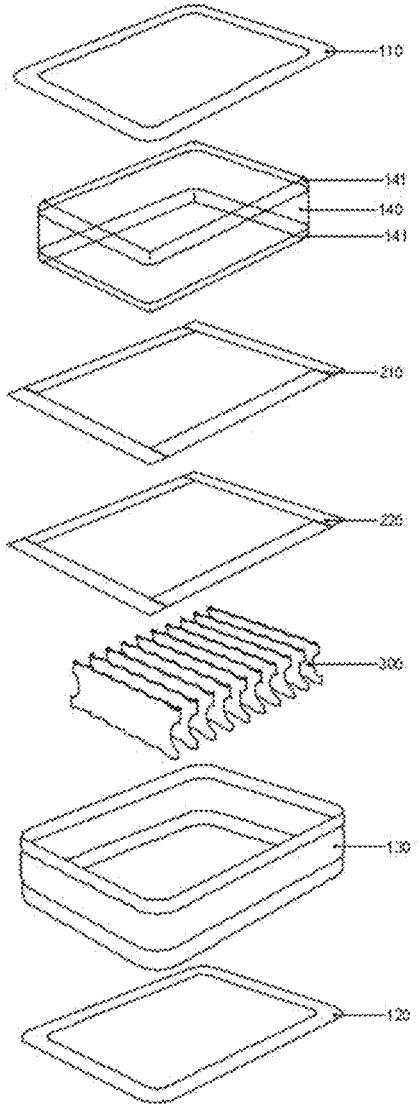
FIG. 4 is an exploded view of the bed body structure in the present invention.

As shown in FIGS. 1, 2 and 4, an air bed including a mattress body formed by a top surface 110, a bottom surface 120 and a side wall. The mattress body is provided with two layers of side walls being an inner side wall 140 and an outer side wall 130 respectively. The inside of the inner side wall 140 forms a bed air chamber 100 of the mattress body. A side wall air chamber 200 of the mattress body is formed between the inner side wall 140 and the outer side wall 130. The inside of the side wall air chamber 200 between the inner side wall 140 and the outer side wall 130 is connected with side wall drawstrings which form a bed edge of the mattress body with the inner side wall 140, the outer side wall 130, and a side wall top surface/side wall bottom surface respectively.

The drawstrings 200 include two sets of side wall drawstrings, which are an upper side wall drawstring 210 and a lower side wall drawstring 220 respectively. The upper side wall drawstring 210 is connected between a medium-upper part of the inner side wall 140 and the outer side wall 130. The lower side wall drawstring 220 is connected between a medium-lower part of the inner side wall 140 and outer side wall 130. The side wall air chamber 200 is divided into upper, middle and lower air chambers.

The upper, middle and lower three air chambers of the side wall air chamber 200 are independent of each other, and control air intake and air discharge separately.

Two ends of the side wall drawstrings are respectively connected to the inner side wall 140 and the outer side wall 130, and the side wall drawstrings are arranged in an inclined way in the side wall air chamber 200.

Figure 3:
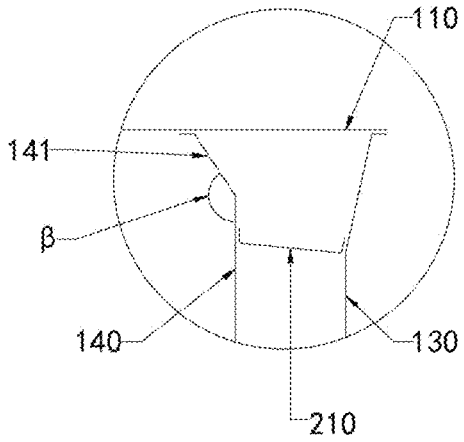
FIG. 3 is a schematic diagram of angle-cutting method in an inner side wall at position 500 in FIG. 2.

As shown in FIGS. 2 and 3, four corners of the inner side wall 140 are provided with angle-cutting lines 141 extending from top/bottom of the inner side wall 140 to connection positions between the inner side wall and the side wall drawstrings, and the connection positions between the inner side wall 140 and the side wall drawstrings are staggered from end-point positions of the angle-cutting lines 141.

The angle-cutting lines intersect with the inner side wall, and the angles formed by the intersection are oblique pulling angles β which are obtuse angles.

As shown in FIG. 2, the position where the inner side wall 140 welds or bonds the top surface of the bed air chamber 100 is a first connection position 201; the position where the inner side wall 140 welds or bonds the upper side wall drawstring 210 is a second connection position 202; the position where the inner side wall 140 welds or bonds the lower side wall drawstring 220 is a third connection position 203; the position where the inner side wall 140 welds or bonds the bottom surface of the bed air chamber 100 is a fourth connection position 204; the position where the outer side wall 130 welds or bonds the top surface of the mattress body is a fifth connection position 205; the position where the outer side wall 130 welds or bonds the upper side wall drawstring 210 is a sixth connection position 206; the position where the outer side wall 130 welds or bonds the lower side wall drawstring 220 is a seventh connection position 207; and the position where the outer side wall 130 welds or bonds the bottom surface of the mattress body is an eighth connection position 208. Each connection position has a different position. The oblique pulling angles are respectively provided between the first connection position 201 and the second connection position 202, and between the third connection position 203 and the fourth connection position 204.

The top surface 110 of the bed air chamber 100 is formed by bonding a flock layer and a PVC/TPU layer in which the flock layer is provided outside the PVC/TPU layer; the bottom surface 120 of the bed air chamber 100 is formed by bonding a cloth layer and a PVC/TPU layer in which the cloth layer is provided outside the PVC/TPU layer; the outer side wall 130 of the bed air chamber 100 is formed by bonding a cloth layer and a PVC/TPU layer; the inner side wall 140 is made of PVC or TPU.

Figure 5:
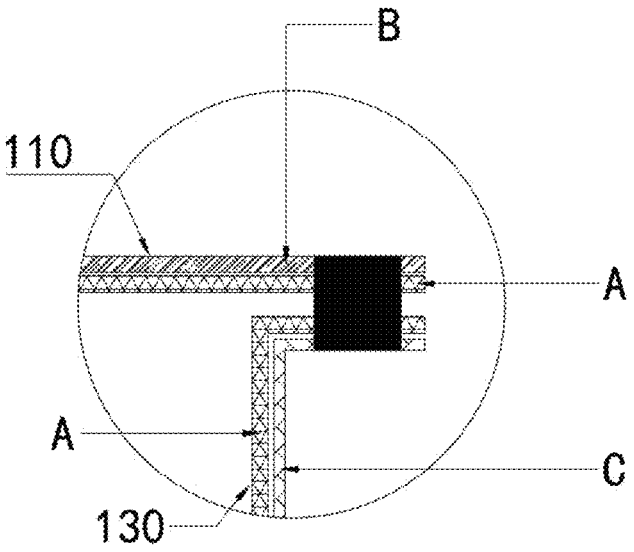
FIG. 5 is a schematic diagram of welding a top surface and an outer side wall.

As shown in FIG. 5, the top surface 110 of the bed air chamber is formed by bonding a flock layer B and a PVC layer A. The flock layer B of the top surface 110 is provided outside the PVC layer A, and the top surface of the bed air chamber extends to the top of the outer side wall to weld and bond the outer side wall. The outer side wall is formed by bonding a cloth layer C and the PVC layer A, and the cloth layer C of the outer side wall 130 is provided outside the PVC layer A.

Figure 6:
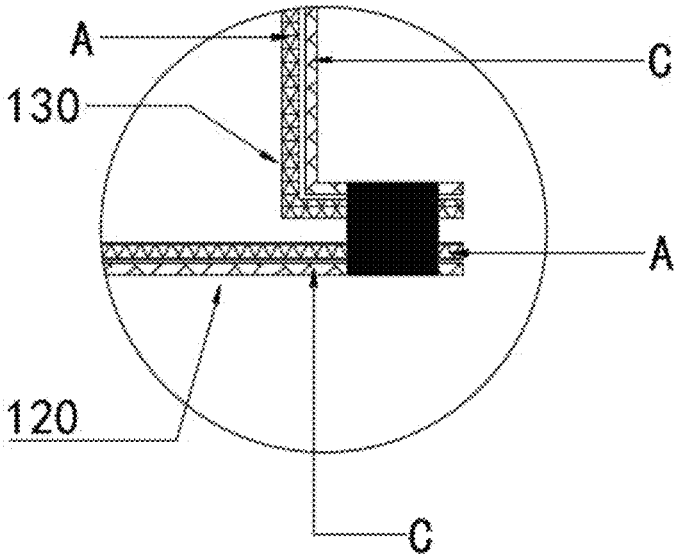
FIG. 6 is a schematic diagram of welding a bottom surface and the outer side wall.

As shown in FIG. 6, the bottom surface 120 of the bed air chamber is formed by bonding the cloth layer C and the PVC layer A. The cloth layer C of the bottom surface 120 is provided outside the PVC layer A, and the bottom surface of the bed air chamber extends to the bottom of the outer side wall to weld and bond the outer side wall.

The PVC layers A of the top surface 110, the bottom surface 120 and the outer side wall 130 are all provided on the inside, and the flock layer B/cloth layer C is provided on the outside, so that the noise reduction effect is better. Both the connection between the top surface 110 and the outer side wall 130 and the connection between the bottom surface 120 and the outer side wall 130 are firstly achieved through the connection and welding of the PVC layer A and the PVC layer A, so that the air tightness and toughness of the joint are more ensured and the mattress is more stable.

The hardness value of the bottom surface 120 of the bed air chamber 100 is greater than the harness value of the top surface 110 of the bed air chamber 100.

According to the technical scheme, due to the fact that the structural layers of the top surface 110 and the bottom surface 120 are different, and the PVC hardness value of the structural layer of the top surface 110 is lower than the PVC hardness value of the structural layer of the bottom surface 120, that is, the top surface 110 has a larger flexibility. The PVC hardness degree of the PVC/TPU layer on the top surface 110 of the mattress body is adjusted to 40 PHR so as to further enable the mattress body to maintain flat with pleasing appearance and avoid the formation of bread-like projection on the surface of the mattress body, thereby better matching and adapting the PVC hardness degree and flexibility of the structural layer on the bottom surface 120.

A higher PHR value leads to a lower PVC hardness degree of PVC, a larger expansion coefficient of PVC mattress body, larger flexibility and easier deformation; or on the contrary, the expansion coefficient is smaller, the flexibility is smaller, and the mattress body is not easy to deform. As to traditional PVC mattresses, the PVC hardness degree is generally required to be between 50 and 56 PHR in order to acquire a balance between the expansion coefficient and the flexibility.

The parameter PHR means the parts of added rubber or resin per 100 parts (by mass) of PVC material, and the PVC hardness degree of the PVC is indirectly indicated by the parts of indirect adding the rubber or the resin. The PHR value can be measured using a Rockwell hardness tester.

The flock layer on the top surface 110 is fiber velvet which does not affect the flexibility of PVC after bonding PVC. The cloth of the cloth layer on the bottom surface 120 is an integral part after bonding PVC since the cloth has small flexibility or no flexibility. Therefore, the cloth layer acts to restrain and restrict the flexibility of the PVC, thereby limiting the expansion and deformation of the mattress body. The PVC harness degree of the bonding layer on the bottom surface 120 is adjusted to between 60 and 70 PHR. Therefore, the PVC hardness degree of the bonding layer on the bottom surface 120 is lower, and it is ensured that the bottom surface 120 is not easy to deform, gives people more comfort when is used, and further meets the needs of the user.

The cloth layer is made of nylon.

As shown in FIG. 2, the bed air chamber 100 is provided with a plurality of bed drawstrings 300 which are respectively connected to the top surface 110 and the bottom surface 120 of the bed air chamber 100 and are arranged in an inclined way in the bed air chamber 100.

Figure 7:
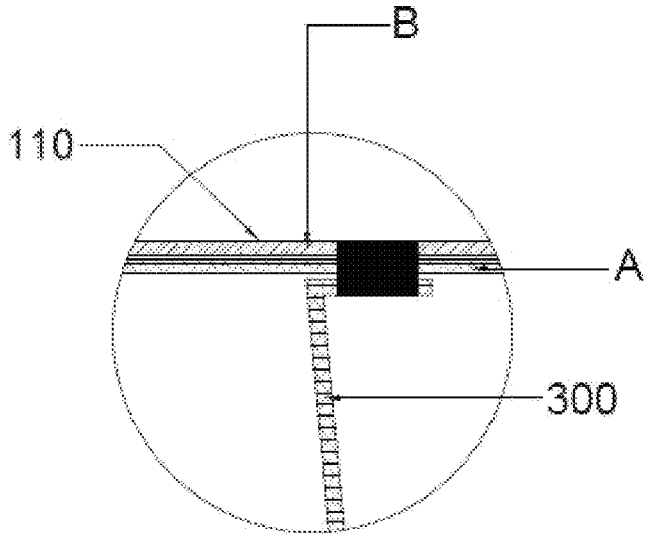
FIG. 7 is a schematic diagram of welding the top surface of a bed air chamber and bed drawstrings.
Figure 8:
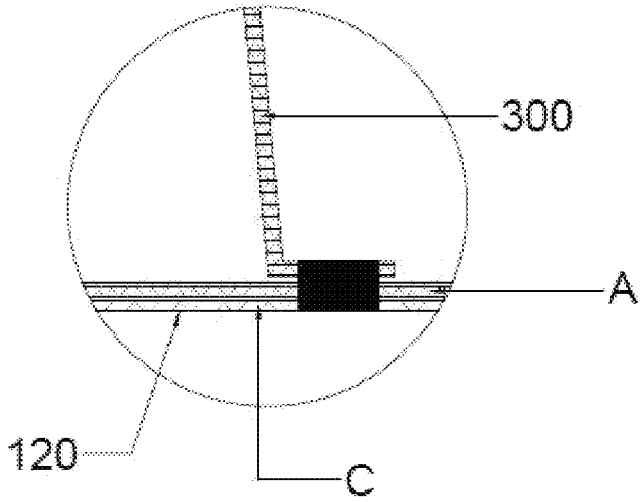
FIG. 8 is a schematic diagram of welding the bottom surface of the bed air chamber and the bed drawstrings.

As shown in FIGS. 7 and 8, the bed drawstrings 300 are welded and bonded to the top surface 110 and the bottom surface 120 of the bed air chamber 100 respectively.

The obliquely arranged bed drawstrings 300 are gradually inclined from the top surface 110 of the bed air chamber 100 to the bottom surface 120 of the bed air chamber 100 towards the direction of the inner side wall 140.

Due to the fact that the structural layers of the top surface 110 and the bottom surface 120 of the bed air chamber 100 are inconsistent with each other, and the force degree of the top surface 110 relative to the bottom surface 120, the degree of expansion, and the hardness degree and the like are also different, so that the inclined arrangement of the bed drawstrings 300 can better match the force on different sides, and the force between the top surface 110 and the bottom surface 120 is more balanced. Meanwhile, the flatness between the top surface 110 and the bottom surface 120 can be adjusted, so that the force applied to the bed air chamber 100 is more balanced, and the stability and aesthetics are better.

As shown in FIG. 2, the more the bed drawstrings 300 are provided towards the center of the bed air chamber 100, the larger the angle formed by the bed drawstrings 300 and the bottom surface 120 of the bed air chamber 100. The range of the angle $\alpha$ formed by the bed drawstrings 300 and the bottom surface 120 of the bed air chamber 100 is $60° < \alpha \leq 90°$.

The center line of the long side of the bed air chamber 100 is taken as the middle. The bed drawstrings 300 are from the middle of the bed air chamber 100 to the inner side wall 140, and the inclination angle formed with the bottom surface 120 of the bed air chamber 100 is gradually reduced. The more the bed drawstrings 300 are provided towards the inner side wall 140, the smaller the angle, and the more the angle is inclined to 60°; the more the bed drawstrings 300 are provided towards the middle of the bed air chamber 100, the larger the angle, and the more the angle is inclined to 90°.

Figure 9:
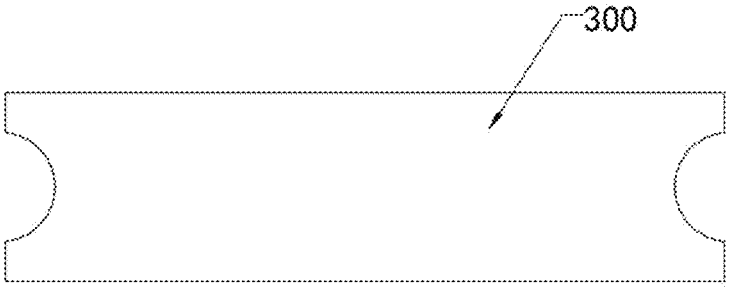
FIG. 9 is a structure diagram of a sheet-shaped drawstring.

As shown in FIG. 9, the bed drawstrings 300 are in a sheet-like structure. The sheet-like bed drawstrings 300 are provided along inner circumference of the bed air chamber 100 and have a curved design at the joint of the top surface 110/bottom surface 120 of the bed air chamber.

Two independent air chambers are provided in the bed air chamber 100 and are arranged in parallel, and control air intake and air discharge separately.

Embodiment 2

Figure 10:
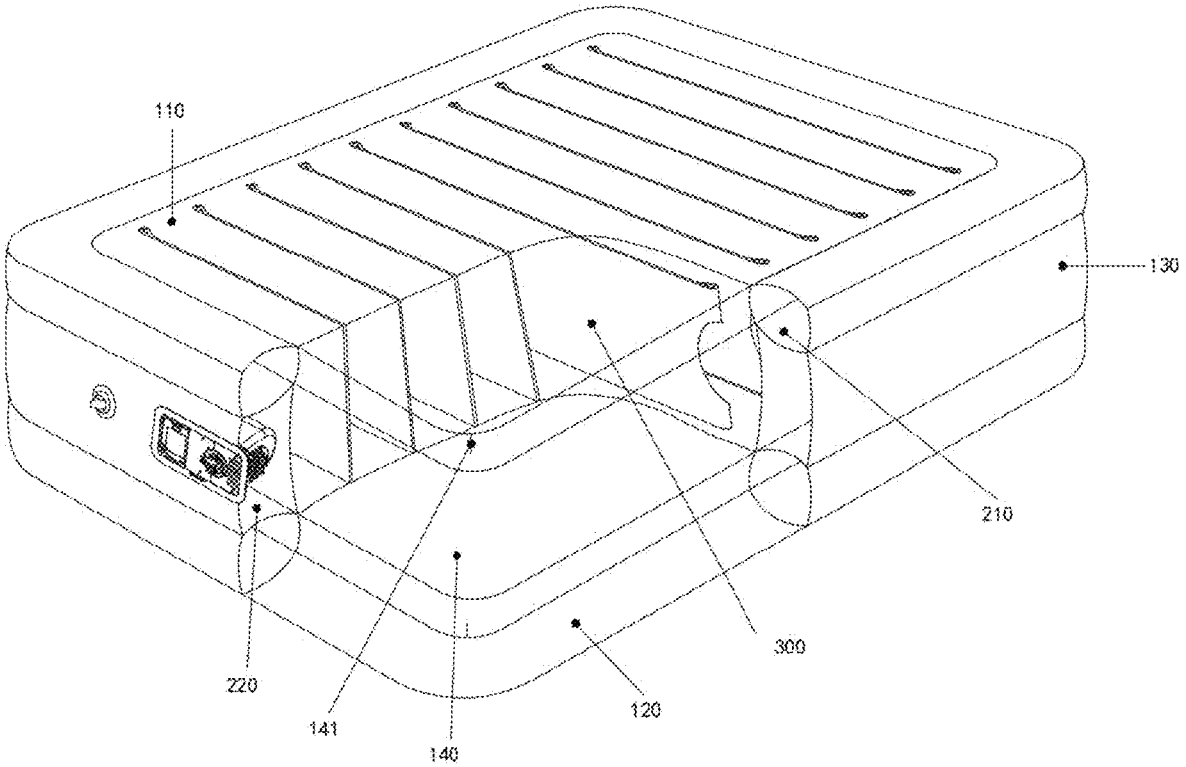
FIG. 10 is a perspective view of structure of the bed body according to a second Embodiment of the present invention.

As shown in FIG. 10, the difference between Embodiment 2 and Embodiment 1 is that the bed drawstrings 300 have a linear design at the joint of the top surface 110/the bottom surface 120 of the bed air chamber.

Embodiment 3

Figure 11:
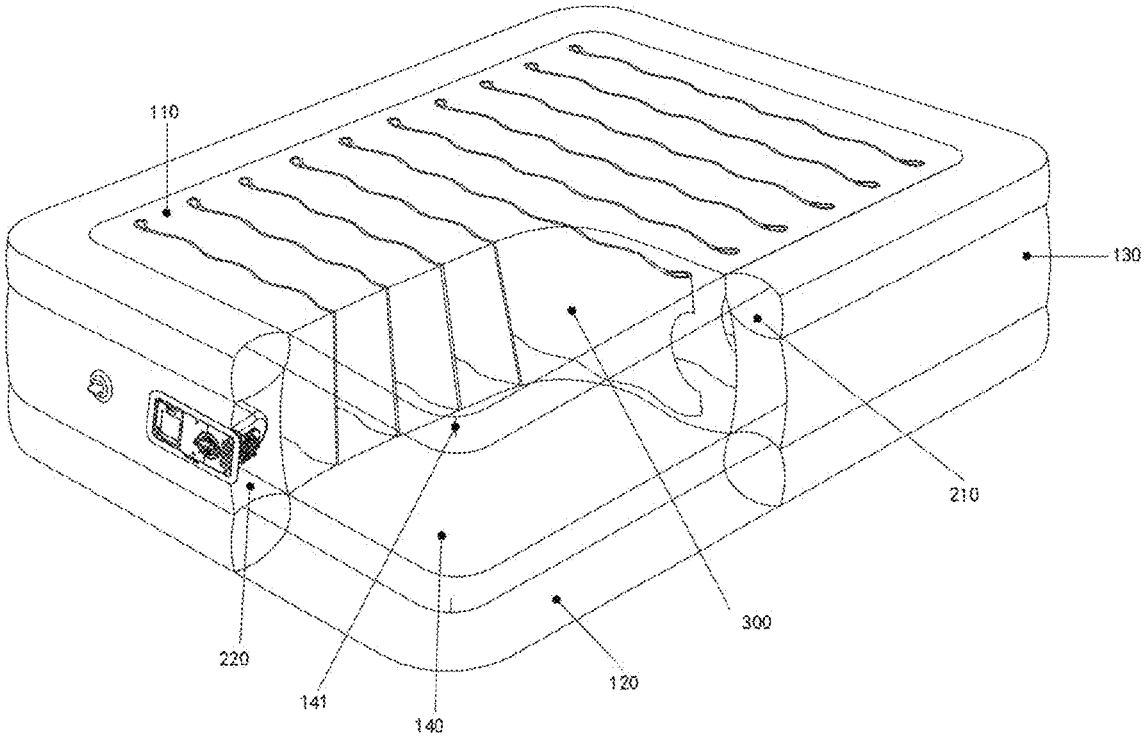
FIG. 11 is a perspective view of structure of the bed body according to a third Embodiment of the present invention.

As shown in FIG. 11, the difference between Embodiment 3 and Embodiment 1 is that the bed drawstrings 300 are in a columnar structure and are uniformly provided in the bed air chamber 100.

Embodiment 4

Figure 12:
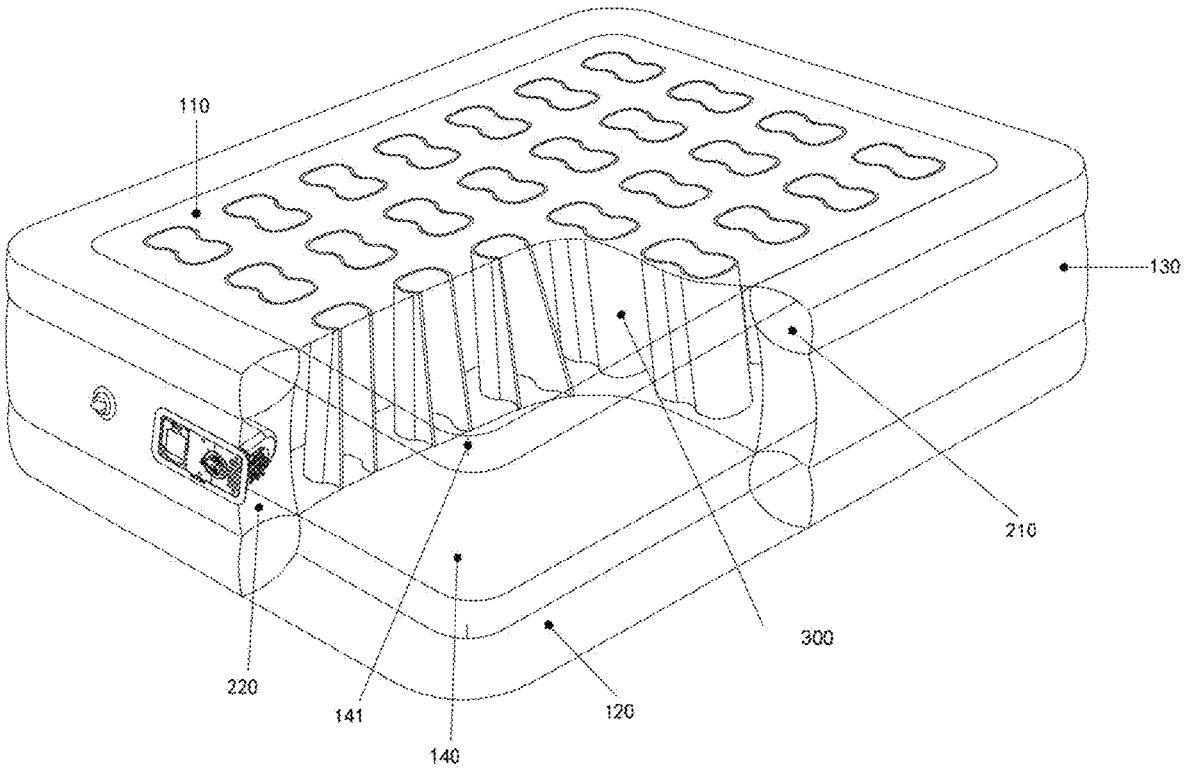
FIG. 12 is a perspective view of structure of the bed body according to a fourth Embodiment of the present invention.

As shown in FIG. 12, the difference between Embodiment 4 and Embodiment 1 is that the bed drawstrings 300 adopt an 8-shaped design, and the 8-shaped drawstrings 300 are arranged in an inclined way in the bed air chamber 100 and are connected to the top surface 110 and the bottom surface 120 of the bed air chamber 100 respectively.

Embodiment 5

Figure 13:
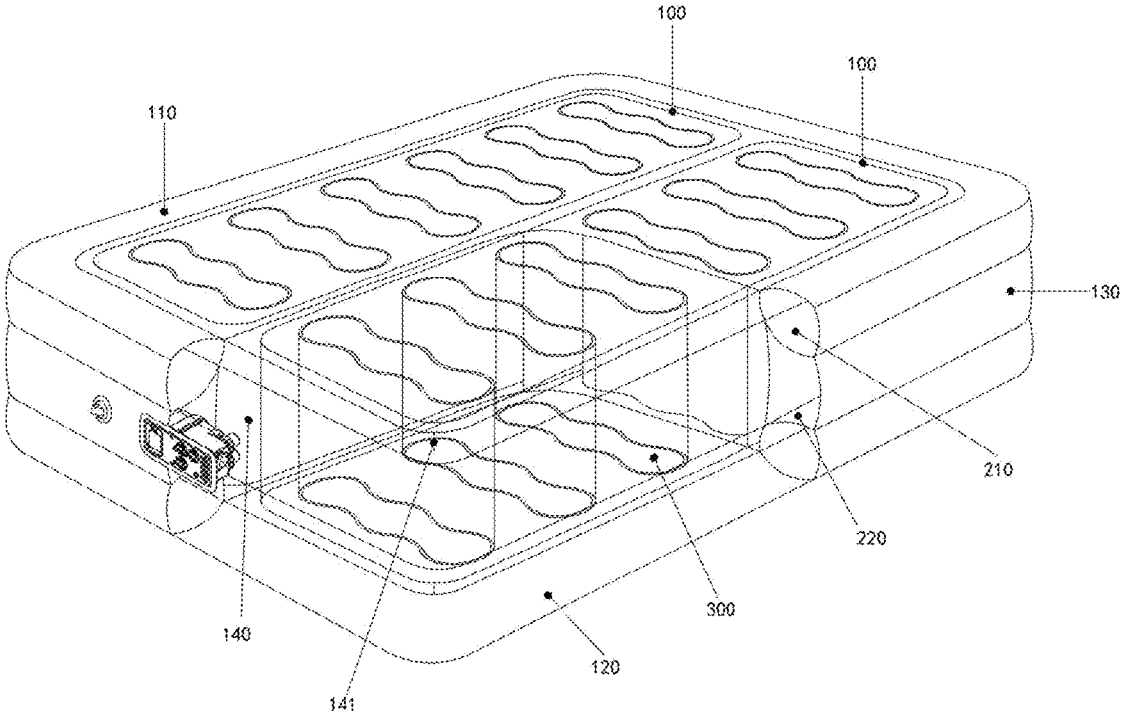
FIG. 13 is a perspective view of structure of the bed body according to a fifth Embodiment of the present invention.

As shown in FIG. 13, the difference between Embodiment 5 and Embodiment 3 is that the bed air chamber 100 is divided into two independent air chambers which are provided in parallel in the space enclosed by the inner side wall 140.

Embodiment 6

Figure 14:
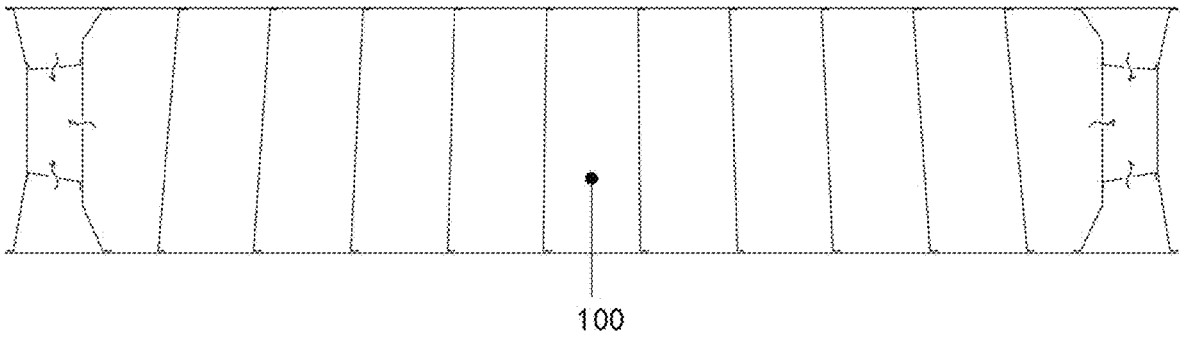
FIG. 14 is a schematic diagram of a common air intake after communicating a side wall air chamber and the bed air chamber.

As shown in FIG. 14, the difference between Embodiment 6 and Embodiment 1 is that the bed air chamber 100 and the side wall air chamber 200 are communicated with each other to form a mattress air chamber. The air bed of Embodiment 6 can not only ensure the supporting effect of the side wall air chamber, but also reduce the use of an air pump, and is simple to use.

Embodiment 7

Figure 15:
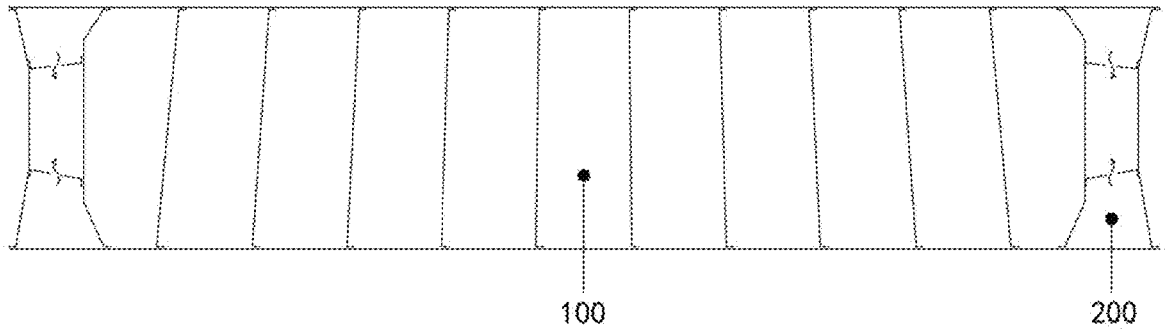
FIG. 15 is a schematic diagram of an independent air intake by the side wall air chamber and the bed air chamber.

As shown in FIG. 15, the difference between Embodiment 7 and Embodiment 1 is that the bed air chamber 100 and the side wall air chamber 200 are independent of each other, and the upper, middle and lower three air chambers of the side wall air chamber are communicated with each other. The air bed of Embodiment 7 can not only ensure the supporting effect of the side wall air chamber, but also independently adjust the hardness degree of the side wall air chamber, and the height of the bed body can be more guaranteed.

Embodiment 8

Figure 16:
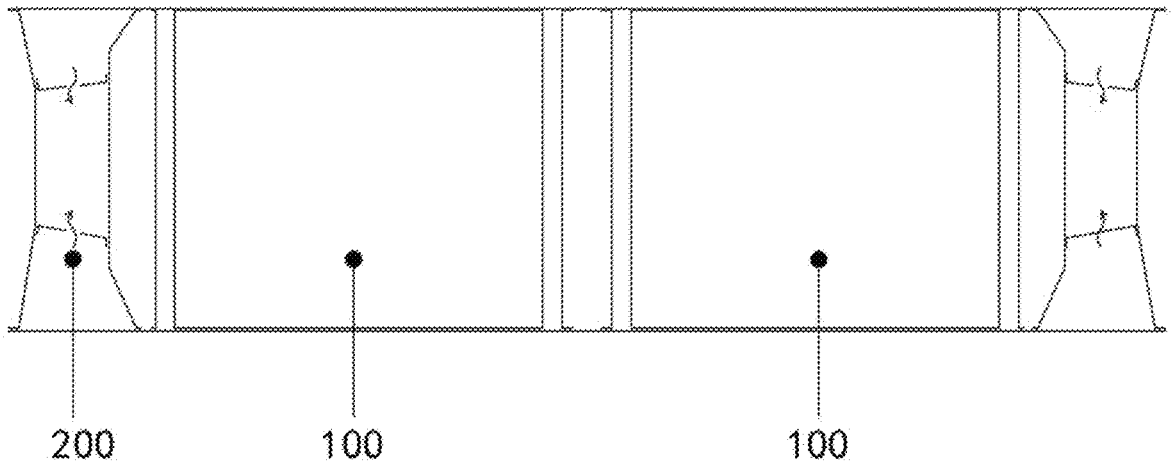
FIG. 16 is a schematic diagram of the independent air intake after the bed air chamber is divided into two separate air chambers.

As shown in FIG. 16, the difference between Embodiment 8 and Embodiment 7 is that the bed air chamber 100 is divided into two independent air chambers, which facilitates independent inflation and deflation of the left and right portions of the bed air chamber 100. The air bed of Embodiment 8 can not only ensure the supporting effect of the side wall air chamber, but also independently adjust the hardness degree of the side wall air chamber 200, and can independently adjust the hardness degree of the left and right portions of the bed air chamber 100 to meet the requirements on hardness degree of different groups of people.

Embodiment 9

The difference between Embodiment 9 and Embodiment 1 is that the cloth layer C is made of polyester.

Embodiment 10

The difference between Embodiment 10 and Embodiment 1 is that the cloth layer C is made of polyester-cotton blended fabrics.

Embodiment 11

The difference between Embodiment 11 and Embodiment 1 is that the cloth layer C is made of cotton cloth.

Embodiment 12

The difference between Embodiment 12 and Embodiment 1 is that the cloth layer C is made of mesh cloth.

Embodiment 13

Figure 17:
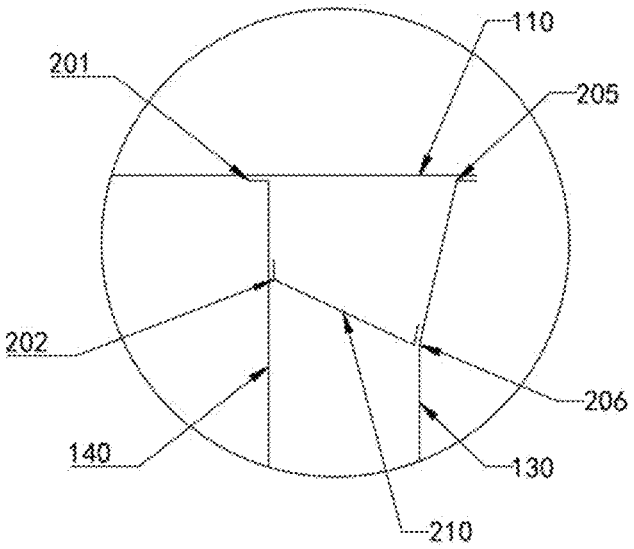
FIG. 17 is a structural schematic diagram without angle-cutting lines provided on the inner side wall in the side wall air chamber of a thirteenth Embodiment.

As shown in FIG. 17, the difference between Embodiment 13 and Embodiment 1 is that no angle-cutting line is provided on the inner side wall in the present embodiment.

Embodiment 14

Performance Testing

1. Material Preparation

Figure 18:
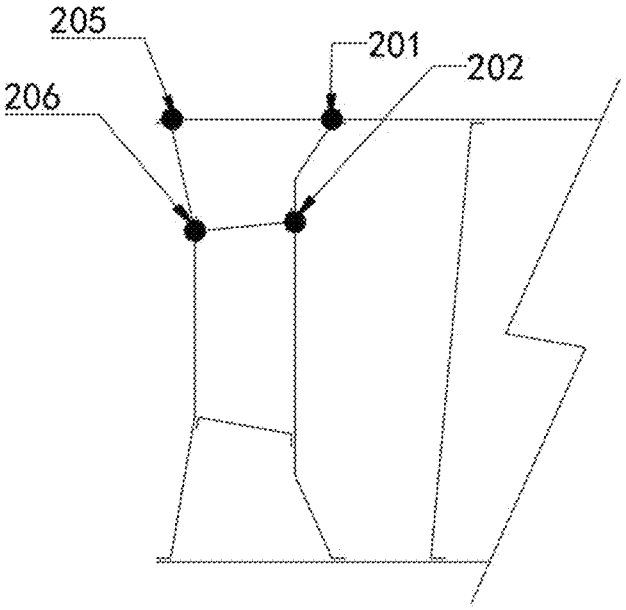
FIG. 18 is a structural diagram of an upper air chamber connection of the side wall air chamber of the present invention in a fourteenth Embodiment.

① In the present testing experiment, products of embodiments are the air beds obtained in Embodiments 1 to 13, and the number of the inflatable mattresses for each embodiment is 10;

the upper air chamber of the side wall air chamber in Embodiments 1 to 13, as shown in FIG. 18, is formed by connecting the first connection position 201, the second connection position 202, the fifth connection position 205 and the sixth connection position 206.

Figure 20:
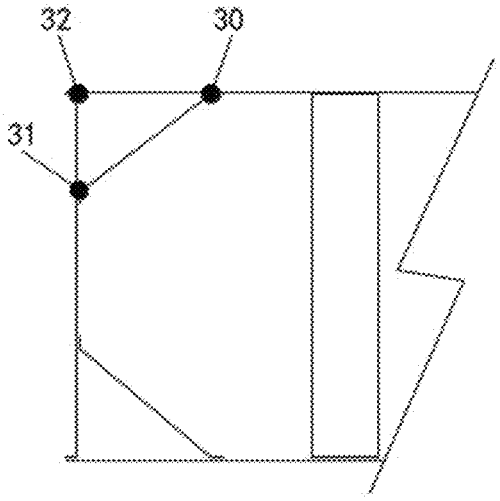
FIG. 20 is a structural diagram of connection for a bed edge air chamber of the air bed in Comparative Example 1 in the fourteenth Embodiment.

② An air bed of a comparative example is prepared and is numbered as Comparative Example 1, and the number of the inflatable mattresses in the comparative example is 10; the air beds in the Comparative Example 1 are traditional PVC mattresses, and the inflatable mattresses in the comparative example are obtained by PVC welding; the thickness of the mattress material in the Comparative Example 1 is the same as that of the mattress material in the embodiments;

the bed edge air chamber of the air bed in the Comparative Example 1 was formed by connecting an intersection 30 of the top surface and the drawstrings, as shown in FIG. 20, an intersection 31 of the side wall and the drawstrings, and an intersection 32 of the side wall and the top surface.

2. Explosion-Proof Testing

The mattresses in the embodiments and the comparative example are inflated, and inflation pressure of each mattress is measured by a professional air pressure detector; the air pressure value at the time of explosion when inflating each mattress is recorded, and explosive limit value of each mattress is obtained by conversion; the air pressure of each air chamber of the air bed is the same; and the higher the explosive limit value, the better the explosion-proof performance.

3. Expanding Volume Testing

The mattresses in the embodiments and the comparative example are inflated respectively, and the change of expanding volume of the bed body is recorded when the air pressure within the inflatable mattress reaches 1 PSI. The smaller the expanding volume, the better the effect and the flatter the bed body is.

4. Rolling Testing

Rolling testing for the mattresses in the embodiments and the comparative example is carried out using a 120 kg roller respectively, and rolling times of the roller is recorded when the mattress breaks or leaks.

5. Impact Testing

Objects weighing 60 kg are used respectively for free falls at a height of 30 cm from the top surface of the mattress, and the times of free falls are recorded when the mattress breaks or leaks.

6. The Testing Results are Shown in Table 1 Below.

TABLE 1

| Test item | Inflatable mattress in the comparative example | Inflatable mattresses in Embodiments 1 to 13 |
|---|---|---|
| Explosion-proof testing | Explosive limit value: 1.5 PSI | Explosive limit value: 2.1 to 2.6 PSI |
| Expanding volume testing | More than 2 times the original volume | Less than 1.2 times the original volume |
| Rolling testing | Less than 8,000 times | More than 15,000 times |
| Impact testing | Less than 3,000 times | More than 6,000 times |

Figure 19:
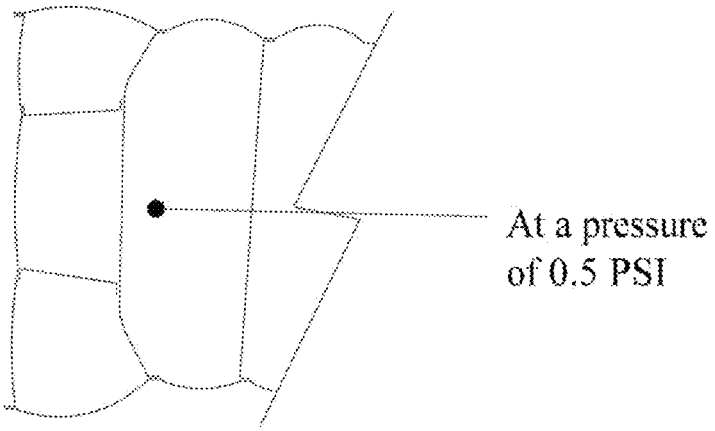
FIG. 19 is an effect graph of the present invention when the air bed is inflated at a pressure of 0.5 PSI in the fourteenth Embodiment.

As shown in FIG. 19, at the explosion-proof testing stage, the air beds in Embodiments 1 to 13 have a small extent of expansion, are not easy to deform, and are tough and firm and high in air-pressure carrying capacity when the air pressure in the side wall air chamber reaches 0.5 PSI. A tester feels comfortable when lying on the air bed.

Figure 21:
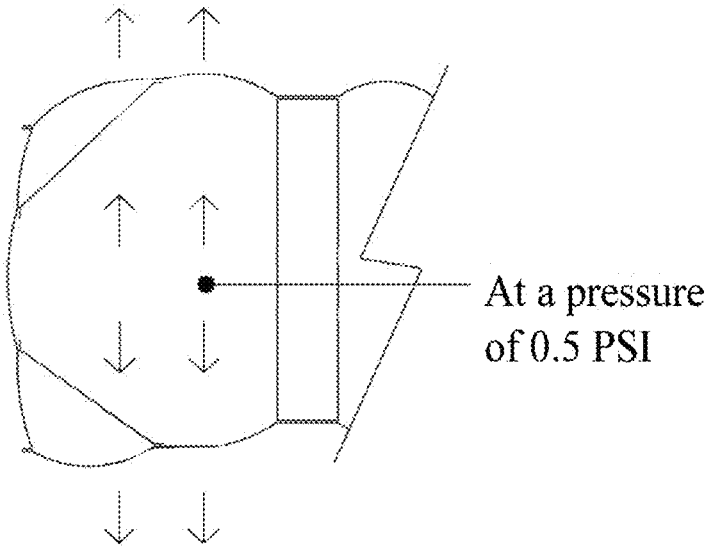
FIG. 21 is an effect graph of the Comparative Example 1 when the air bed is inflated at a pressure of 0.5 PSI in the fourteenth Embodiment.

As shown in FIG. 21, at the explosion-proof testing stage, the air bed in the Comparative Example 1 has a large extent of expansion, is easy to have an upward bulge or a downward convex, which shows that the air bed is low in air-pressure carrying capacity. The tester feels less comfortable when lying on the air bed.

In addition, the tests showed that the performances of the air beds in Embodiments 1 to 13 are significantly better than the performance of the air bed in the Comparative Example 1, and the performances of the air beds in Embodiments 1 to 12 are superior to the performance of the air bed in Embodiment 13.

Summary: After testing, the air beds obtained in Embodiments 1 to 13 have a good explosion-proof effect and a long service life, and are not easy to deform and are tough and high in safety performance and comfort.

Obviously, the above embodiments of the present invention are merely examples for clear illustration of the technical scheme in the invention, and are not intended to limit the implementations of the present invention. Any modification, equivalent substitution or improvement and the like within the spirit and principle of the claims of the present invention should be included in the scope of claims of the present invention.

The invention claimed is:

1. An air bed, comprising a mattress body defined by a top surface, a bottom surface and a side wall, wherein the mattress body has at least two layers of side walls including an inner side wall and an outer side wall, an inside of the inner side wall forms a bed air chamber of the mattress body, a side wall air chamber of the mattress body is formed between the inner side wall and the outer side wall, in the side wall air chamber, at least one side wall drawstring surrounding the inner side wall is provided, each of the at least one side wall drawstring connects the inner side wall and the outer side wall, and a bed edge of the mattress body is formed by the side wall drawstring, the inner side wall, the outer side wall, and the top surface, or formed by the side wall drawstring, the inner side wall, the outer side wall, and the bottom surface, wherein two ends of each of the at least one side wall drawstring are respectively connected to the inner side wall and the outer side wall, and the at least one side wall drawstring is arranged in parallel each other or arranged in an inclined way in the side wall air chamber, and each of four corners of the inner side wall is provided with an angle-cutting line extending from top/bottom of the inner side wall to a connection position where the inner side wall and the side wall drawstring connect, and the connection position is staggered from an end-point position of the angle-cutting line.

2. The air bed according to claim 1, wherein a top surface of the bed air chamber is formed by bonding a flock layer and a PVC/TPU layer and the flock layer is provided outside the PVC/TPU layer; a bottom surface of the bed air chamber is formed by bonding a cloth layer and a PVC/TPU layer and the cloth layer is provided outside the PVC/TPU layer; and a side wall of the bed air chamber is formed by bonding a flock layer and a PVC/TPU layer, or a cloth layer and a PVC/TPU layer.

3. The air bed according to claim 2, wherein the hardness value of the bottom surface of the bed air chamber is greater than the harness value of the top surface of the bed air chamber.

4. The air bed according to claim 1, wherein the angle-cutting lines intersect with the inner side wall, and the angles formed by the intersection are oblique pulling angles which are obtuse angles.

5. The air bed according to claim 1, wherein the inside of the bed air chamber is provided with a plurality of bed drawstrings, which are respectively connected to the top surface and the bottom surface of the bed air chamber and are at least partially arranged in an inclined way in the bed air chamber.

6. The air bed according to claim 5, wherein the obliquely provided bed drawstrings are gradually inclined from the top surface of the bed air chamber to the bottom surface of the bed air chamber towards a direction of the inner side wall.

7. The air bed according to claim 5, wherein the bed drawstrings are in a sheet-like or columnar or ring structure, sheet-like bed drawstrings are provided along inner circumference of the bed air chamber and has a curved or linear design at a joint of the top surface/bottom surface of the mattress body, and the bed drawstrings in the columnar or ring structure are uniformly provided in the bed air chamber.

8. The air bed according to claim 1, wherein at least two sets of side wall drawstrings are provided, including an upper side wall drawstring and a lower side wall drawstring, the upper side wall drawstring is connected between a medium-upper part of the inner side wall and the outer side wall, the lower side wall drawstring is connected between a medium-lower part of the inner side wall and outer side wall, the side wall air chamber is divided into an upper air chamber, a middle air chamber and a lower air chamber.

9. The air bed according to claim 8, wherein the upper air chamber, middle air chamber and lower air chamber of the side wall air chamber are independent of each other and control air intake and air discharge separately; or the upper air chamber, middle air chamber and lower air chamber of the side wall air chamber are communicated with each other to form one air chamber, and the bed air chamber and the side wall air chamber are independent of each other; or the upper air chamber, middle air chamber and lower air chamber of the side wall air chamber are communicated with the bed air chamber of the mattress body to form one air chamber.

* * * * *